US006267120B1

(12) United States Patent
Serignat

(10) Patent No.: US 6,267,120 B1
(45) Date of Patent: Jul. 31, 2001

(54) HAIR CLIP

(75) Inventor: Serge Serignat, Arbent (FR)

(73) Assignee: Navarro France S.A., Dortan (FR)

( * ) Notice: Subject to any disclaimer, the term of this patent is extended or adjusted under 35 U.S.C. 154(b) by 0 days.

(21) Appl. No.: 09/551,896

(22) Filed: Apr. 19, 2000

(30) Foreign Application Priority Data

Mar. 31, 2000 (FR) ..... 00 04130

(51) Int. Cl.[7] ..... A45D 8/04; A45D 8/12
(52) U.S. Cl. ..... 132/273; 132/275
(58) Field of Search ..... 132/273, 275, 132/278, 276, 280, 281, 282, 283, 284

(56) References Cited

U.S. PATENT DOCUMENTS 565,884 * 8/1896 Emmons ..... 132/275
595,926 * 12/1897 Skillen ..... 132/275
717,499 * 12/1902 Gouy ..... 132/275
887,149 * 5/1908 Tarnow ..... 132/275
1,027,668 * 5/1912 Pritzkow ..... 132/273
2,661,748 * 12/1953 Racho ..... 132/275
2,832,358 * 4/1958 Chambers ..... 132/273
5,186,186 * 2/1993 Hamilton ..... 132/200
5,365,954 * 11/1994 Rude ..... 132/275
5,566,690 * 10/1996 Shih-Ming ..... 132/276
5,797,408 * 8/1998 Wilson ..... 132/275
5,901,713 * 5/1999 Mroczek ..... 132/275

* cited by examiner

*Primary Examiner*—John J. Wilson
*Assistant Examiner*—Robyn Kieu Doan
(74) *Attorney, Agent, or Firm*—Dowell & Dowell, P.C.

(57) ABSTRACT

A hair clip including a substantially rigid base plate as well as a toric elastic element wherein the base plate includes, at a first lateral end, an element for removably securing the elastic element to the base plate by clipping and, at a second lateral end, a hook for removably hooking the elastic element. The base plate has a curved profile so as to form, with the elastic element, an interior volume for retaining hair.

8 Claims, 1 Drawing Sheet

HAIR CLIP

BACKGROUND OF THE INVENTION

The present invention relates to a hair clip.

BRIEF STATEMENT OF THE RELATED ART

Such a clip makes it possible to tie up tufts or locks of hair so as to form in particular bunches, plaits or a pony tail.

It is an object of the invention to provide a hair clip which is of simple design, convenient to use and which reliably holds the hair once tied up.

SUMMARY OF THE INVENTION

To that end, relates to a hair clip, comprising a substantially rigid base plate as well as a toric elastic element, said plate comprising, at a first lateral end, means for fixing said elastic element and, at a second lateral end, means for removably hooking said elastic element, said plate having, in side view, an incurved profile and being adapted to form, with said elastic element, an interior volume for retaining the hair.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
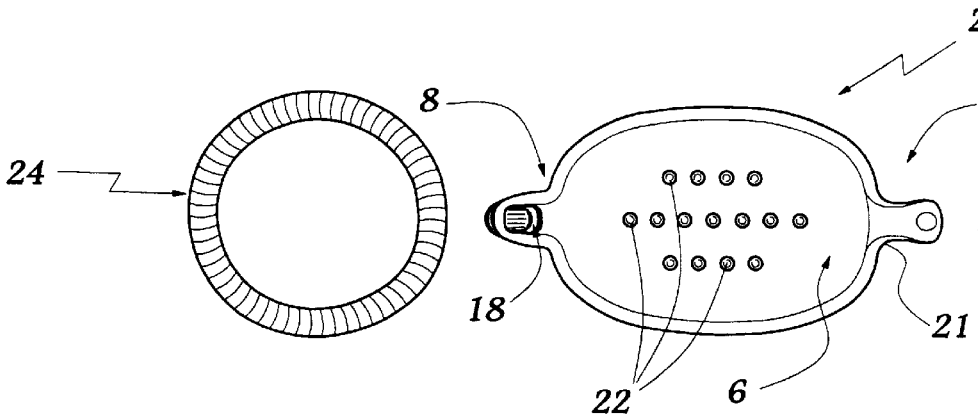
FIG. 1 is a front view of a base plate and an elastic element, separated from one another, which form a hair clip according to the invention.
Figure 2:
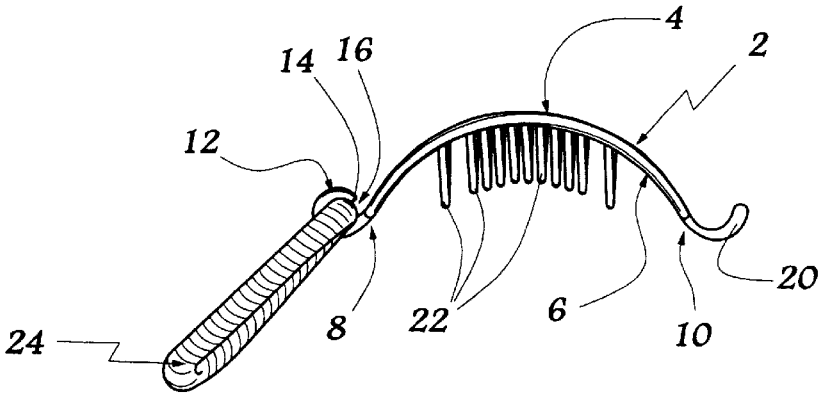
FIG. 2 is a side view of the mechanical elements of FIG. 1, in a position of storage of the clip.
Figure 3:
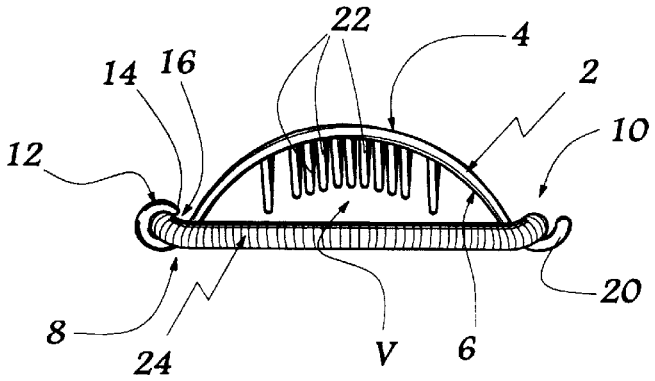
FIG. 3 is a side view, similar to FIG. 2, illustrating the two elements constituting the hair clip of the invention, in their position of use.

Referring now to the drawings, the hair clip shown in FIGS. 1 to 3 comprises a base plate generally designated by reference 2, which is made in one piece from a plastic material, such as cellulose acetate. As shown in FIG. 1, this plate 2, seen from the front, has a substantially oval shape. However, it might have different shapes, such as in particular square or rectangular.

Seen in side view, the plate 2 is incurved, namely it presents an upwardly directed concavity (cf. FIG. 2). The plate 2 which is of small thickness thus has a first, or outer face 4, and a second, or inner face 6. It also has first and second lateral ends referenced 8 and 10.

The first lateral end 8 is extended by a hook 12 which is bent on itself. The free end 14 of this hook 12 defines, with the opposite outer face 4 of the plate 2, a gap 16 intended for the passage of an elastic element, as will be described hereinbelow. It should be noted that hook 12 is provided, near the lateral end 8, with an opening 18.

The plate 2 is provided with a tongue 20 integral therewith, which extends from the second lateral end 10. The transition zone 21 between the tongue 20 and the end 10, forms a shoulder for holding an elastic element, as will be described hereinbelow. The curved tongue has a downwardly facing concavity in FIG. 2, namely opposite the concavity of plate 2. Seen in front view, the hook 12 and the tongue 20 extend in line with each other, substantially along a median axis of the plate 2. The inner face 6 of the plate 2 is, in addition, provided with a plurality of teeth 22.

The hair clip according to the invention also comprises a toric elastic element 24 forming a loop. This element is of circular cross-section, its transverse dimensions, or diameter, being greater than those of the gap 16 of the plate 2, when the latter is at rest.

Assembly of the hair clip will now be described.

In a first step, the user fastens the elastic element 24 on the base plate 2. To that end, she introduces this element 24 through the gap 16, which is rendered possible by crushing the elastic element 24. It should be noted that, near the end 14, the outer surface of the hook 12 is rounded in shape. This ensures a particularly easy introduction of the elastic element 24 in the inner volume of the hook 12.

Once the element 24 is housed in the inner volume of the hook 12 (FIG. 2), this element 24 is reliably secured to the plate. The inner surface of the hook 12 has sharp angles, so as to prevent any accidental disconnection of the element 24.

The user then places the plate 2 against the hair that she wishes to tie up, causing the teeth 22 to penetrate therein. She then manipulates the elastic element 24 so as to hook the latter on the tongue 20, as shown in FIG. 3. Zones 21 ensure reliable retention of this element.

The hair is then held in the inner volume V formed, on the one hand, by the inner face 6 of the plate 2 and, on the other hand, by the elastic element 24 which is in stretched position. It should be noted that the diameter of the elastic element 24 along a transverse section is constant. This element has no protuberance nor added clip, particularly a metallic one, thus avoiding any risk of catching on the walls of the hook 12 and of the tongue 20.

In order to remove the hair clip, it suffices to disconnect the element 24 from the hooking tongue 20, then to remove the plate 2 from the hair thus released.

The invention makes it possible to attain the above-mentioned objectives. In effect, the hair clip according to the invention employs a reduced number of constituent elements which are of particularly simple structure. Furthermore, this clip is particularly easy to manipulate and ensures a satisfactory hold of the hair in the inner volume formed by the plate and the elastic element.

What is claimed is:

1. A hair clip comprising; a substantially rigid molded plastic base plate and a toric elastic element, said base plate including at a first lateral end, means for removably securing said elastic element and, at a second lateral end, a hook for removably hooking said elastic element, said base plate being of convex profile toward said elastic element and forming, with said elastic element, an interior volume for retaining hair.

2. The hair clip of claim 1, wherein said means for removably securing includes a second hook integral with said base plate, said second hook defining, with an outer face of said base plate, opposite the interior volume, a gap for passage of said elastic element, said gap having a transverse dimension which is smaller than that of said elastic element.

3. The hair clip of claim 1, wherein, adjacent a free end thereof, said hook has a rounded outer surface.

4. The hair clip of claim 3, wherein said second hook is provided, adjacent said first lateral end, with an opening.

5. The hair clip of claim 1, wherein the hook includes a tongue integral with said base plate, a concavity of said tongue being directed opposite the convex profile if said base plate.

6. The hair clip of claim 1, wherein an inner face of said base plate, adjacent said interior volume, is provided with teeth extending at least partially into said interior volume.

7. The hair clip of claim 1, wherein, in front view, said means for removably securing and said hook extend in line with each other, substantially along a median axis of said base plate.

8. The hair clip of claim 1, wherein said elastic element has a constant diameter in cross-section.

* * * * *